US008234826B1

(12) United States Patent
Proffitt, Jr.

(10) Patent No.: US 8,234,826 B1
(45) Date of Patent: Aug. 7, 2012

(54) HOLD DOWN CLIP

(76) Inventor: Ray A. Proffitt, Jr., Knoxville, TN (US)

( * ) Notice: Subject to any disclaimer, the term of this patent is extended or adjusted under 35 U.S.C. 154(b) by 28 days.

(21) Appl. No.: 11/463,073

(22) Filed: Aug. 8, 2006

Related U.S. Application Data

(60) Provisional application No. 60/804,889, filed on Jun. 15, 2006.

(51) Int. Cl.
*E02D 27/00* (2006.01)

(52) U.S. Cl. ..... 52/293.3; 52/712; 52/745.21

(58) Field of Classification Search ..... 52/241, 52/481.1, 481.2, 293.3, 712, 745.21, 184, 52/655.1; 256/65.01, 65.02, 65.03; 403/217
See application file for complete search history.

(56) References Cited

U.S. PATENT DOCUMENTS

| | | | | | |
|---|---|---|---|---|---|
| 4,192,118 | A | * | 3/1980 | Gilb | 52/714 |
| 4,665,672 | A | * | 5/1987 | Commins et al. | 52/295 |
| 4,744,192 | A | * | 5/1988 | Commins | 52/714 |
| 4,825,621 | A | * | 5/1989 | Jensen | 52/702 |
| 5,092,097 | A | | 3/1992 | Young | |
| 5,249,404 | A | | 10/1993 | Leek et al. | |
| 5,467,570 | A | * | 11/1995 | Leek | 52/712 |
| 5,535,561 | A | | 7/1996 | Schuyler | |
| 5,979,130 | A | * | 11/1999 | Gregg et al. | 52/295 |
| 6,006,487 | A | * | 12/1999 | Leek | 52/698 |
| 6,014,843 | A | | 1/2000 | Crumley et al. | |
| 6,067,769 | A | | 5/2000 | Hardy | |
| 6,112,495 | A | | 9/2000 | Gregg et al. | |
| 6,158,188 | A | * | 12/2000 | Shahnazarian | 52/702 |
| 6,195,949 | B1 | | 3/2001 | Schuyler | |
| 6,250,041 | B1 | * | 6/2001 | Seccombe | 52/712 |
| 6,298,630 | B1 | * | 10/2001 | VeRost et al. | 52/712 |
| 6,311,449 | B1 | * | 11/2001 | Morse et al. | 52/702 |
| 6,367,205 | B2 | * | 4/2002 | Cornett, Sr. | 52/23 |
| 6,453,634 | B1 | * | 9/2002 | Pryor | 52/713 |
| 6,460,297 | B1 | * | 10/2002 | Bonds et al. | 52/79.1 |
| 6,470,644 | B2 | * | 10/2002 | James et al. | 52/745.06 |
| 6,560,940 | B2 | | 5/2003 | Mueller | |
| 6,688,069 | B2 | * | 2/2004 | Zadeh | 52/715 |
| 6,715,258 | B1 | | 4/2004 | Mueller | |
| 6,842,027 | B2 | | 1/2005 | Liu et al. | |
| 7,014,383 | B2 | * | 3/2006 | Schmid et al. | 403/231 |
| 7,017,312 | B1 | | 3/2006 | Mueller | |
| 7,296,501 | B2 | * | 11/2007 | Leek et al. | 81/176.1 |
| 2002/0002806 | A1 | * | 1/2002 | Commins et al. | 52/481.1 |
| 2002/0062617 | A1 | * | 5/2002 | diGirolamo et al. | 52/688 |
| 2003/0066250 | A1 | * | 4/2003 | Moore | 52/93.1 |
| 2004/0065032 | A1 | * | 4/2004 | Commins | 52/293.3 |
| 2004/0068947 | A1 | * | 4/2004 | Commins et al. | 52/293.3 |
| 2005/0284057 | A1 | | 12/2005 | Commins | |
| 2006/0032180 | A1 | * | 2/2006 | Peterson | 52/712 |
| 2007/0107338 | A1 | * | 5/2007 | Daudet | 52/293.3 |

* cited by examiner

*Primary Examiner* — Jessica Laux
(74) *Attorney, Agent, or Firm* — Luedeka Neely Group, PC

(57) ABSTRACT

A hold down clip, a metal stud assembly structure, and a method for assembling metal studs for building walls. The hold down clip has a base portion containing an elongate slot therein. A leg portion of the clip is orthogonal to the base portion and contains a plurality of bolt holes therein for attaching the leg portion to a metal stud. A reinforcing flange is attached to the leg portion and base portion. A connecting bolt is disposed in a slotted aperture in the base portion for connecting the clip to a floor or to an adjacent metal stud.

12 Claims, 9 Drawing Sheets

HOLD DOWN CLIP

CROSS-REFERENCE TO RELATED APPLICATION

This application claims priority to U.S. Provisional Application Ser. No. 60/804,889, filed on Jun. 15, 2006, and entitled HOLD DOWN CLIP.

FIELD

This disclosure relates to the field of structural connectors. More particularly, this disclosure relates to hold down devices for connecting structural members, such as metal studs, to an underlying foundation, such as a concrete foundation, or to interconnect structural members, such as metal studs of adjacent floors of a structure.

BACKGROUND

Hold down clips are used to anchor structural members to the foundation and/or to one another. Such anchoring and interconnection can add stability and improve the structural capacity of the building structure. However, current hold down clips are cumbersome to handle and install, and often require more than one person to effect assembly to an adjacent hold down clip. Accordingly, there is a need for improved hold down clips for assembling metal studs for building walls.

Accordingly, embodiments of the disclosure provide a hold down clip, a metal stud assembly structure, and a method for assembling metal studs for building walls. The hold down clip has a base portion containing an elongate slot therein. A leg portion of the clip is orthogonal to the base portion and contains a plurality of bolt holes therein for attaching the leg portion to a metal stud. A reinforcing flange is attached to the leg portion and base portion. A connecting bolt is disposed in a slotted aperture in the base portion for connecting the clip to a floor or to an adjacent metal stud.

Another embodiment of the disclosure provides a stud wall assembly structure. The structure includes a metal stud and a hold down structure attached to the metal stud. The hold down structure has a base portion, a leg portion orthogonal to the base portion, a reinforcing flange attached to the leg portion and base portion, and a connecting bolt disposed in a slotted aperture in the base portion. A plurality of bolt holes are provided in the leg portion of the hold down structure for attaching the leg portion to the metal stud.

Yet another embodiment of the disclosure provides a method for reinforcing a metal stud for building walls. According to the method, a hold down clip is provided. The hold down clip includes a base portion containing an elongate slot therein, a leg portion orthogonal to the base portion containing a plurality of bolt holes, a reinforcing flange attached to the leg portion and base portion, and a connecting bolt disposed in a slotted aperture in the base portion. The leg portion of the hold down clip is bolted to a metal stud using a plurality of bolts.

An advantage of the hold down clip as described herein is that the clip may be more quickly attached to a metal stud using a smaller number of bolts rather than a large number of machine screws. For example, it takes less than half the number of bolts compared to the number of machine screws to fixedly attach the leg portion of the hold down clip to a metal stud. Another advantage of the hold down clip is that the adjacent studs may be assembled together to provide a second level wall by bolting a base portion of the clip to a base portion of a second clip wherein the bolt may be tightened by a single person.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
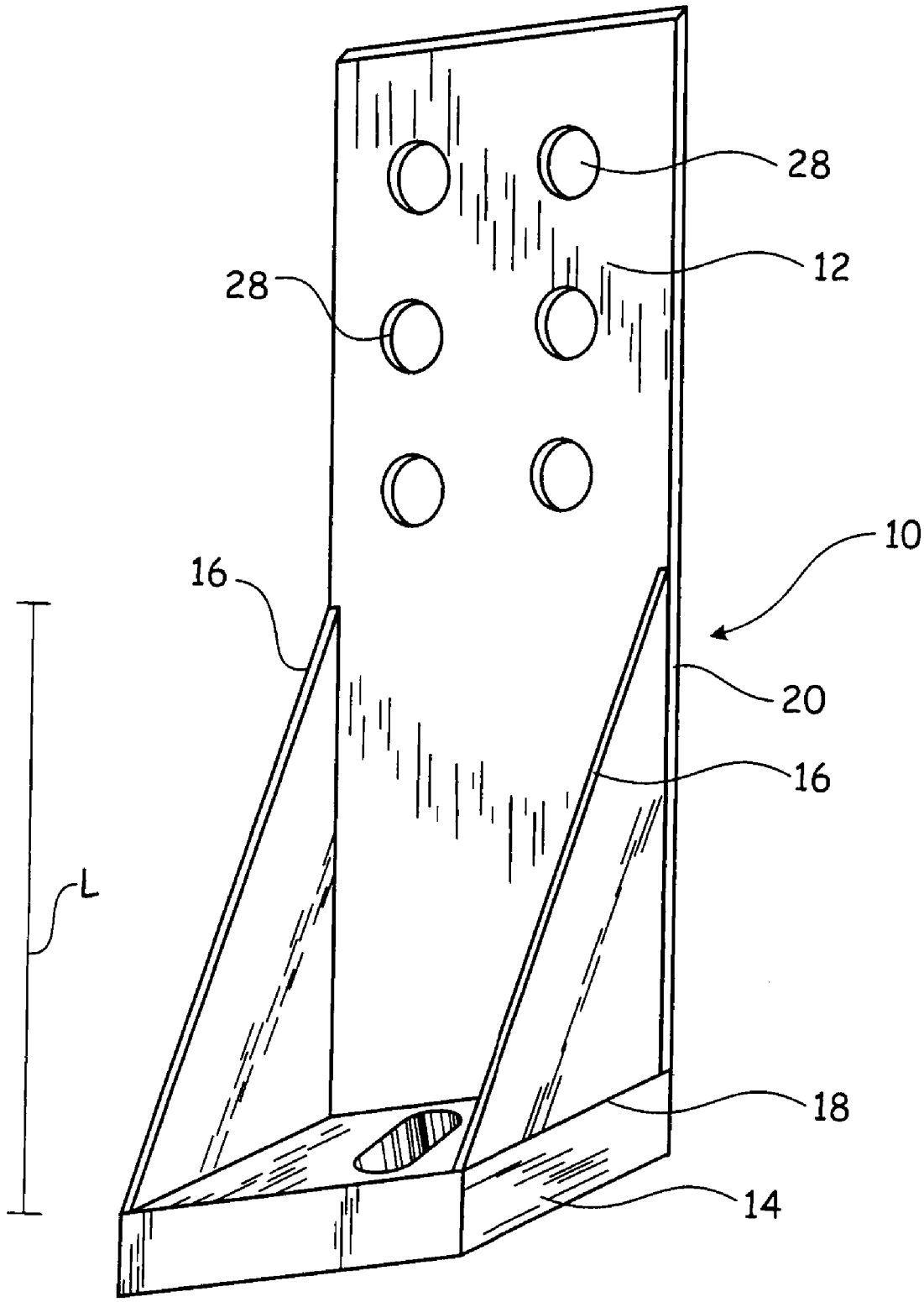
FIG. 1 is a perspective view of a hold down clip according to an exemplary embodiment of the disclosure.

With reference to the drawings, the disclosure relates to an improved hold down clip 10 (FIG. 1). The clip 10 is generally an L-shaped structure that includes a leg portion 12, a substantially perpendicular base portion 14, and one or more reinforcing flanges 16 which are attached to the leg portion 12 and the base portion 14. The clip 10 is preferably made of welded steel construction.

For the purpose of example, the leg portion 12 may have a thickness of about 3/16 inch, a width of about 3 inches, and a length of about 11 inches. The base portion 14 may have a thickness of about ¾ inch, a width of about 2½ inches, and a length of about 3½ inches. The one or more flanges 16 may each have a thickness of about ¼ inch and configured to be secured to edges 18 of the base portion 14 and edges 20 of the leg portion 12. The one or more reinforcing flanges 16 may have a length L that ranges from about 3 to about 6 inches.

Unlike conventional hold down clips, the clip 10 advantageously uses bolts 22 (FIG. 2) for attaching the clip 10 to a metal stud 24 and an associated support 26 oriented generally orthogonal to the stud 24. The bolts 22 are passed through apertures 28 (FIG. 1) in the leg portion 12 of the clip 10. The apertures 28 are aligned with corresponding apertures 30 (FIG. 3) defined through the metal stud 24. The bolts 22 are secured by use of nuts 32 threaded onto free end of the bolts 22. Conventional circular washers 34 are typically used with the nuts 32. The apertures 30 may be formed as by drilling through the metal studs 24 using the apertures 28 in the clip 10 as a guide. The apertures may be formed at the time of installation of the clip 10 to the stud 24 to enable custom fitting of the clip 10 to the stud 24.

Conventional hold down clips utilize a large number of small machine screws to secure a hold down clip to a metal stud. Installing the large number of machine screws is time consuming and may not provide the stability that the bolts 22 provide. The use of a substantially fewer number of larger bolts 22 speeds up attachment time and offers improved strength. For example, a hold down clip having a leg portion 12 length of about 14 inches may have 24 machine screws and a leg portion 12 length of about 21.5 inches may have 48 machine screws. By contrast, only from about 4 to about 8 of the bolts 22, or about one fourth to about one sixth as many bolts 22 are used for the leg portion 12 of the clip 10 according to the disclosure as compared to the number of machine screws that would be used for a conventional hold down clip.

Figure 2:
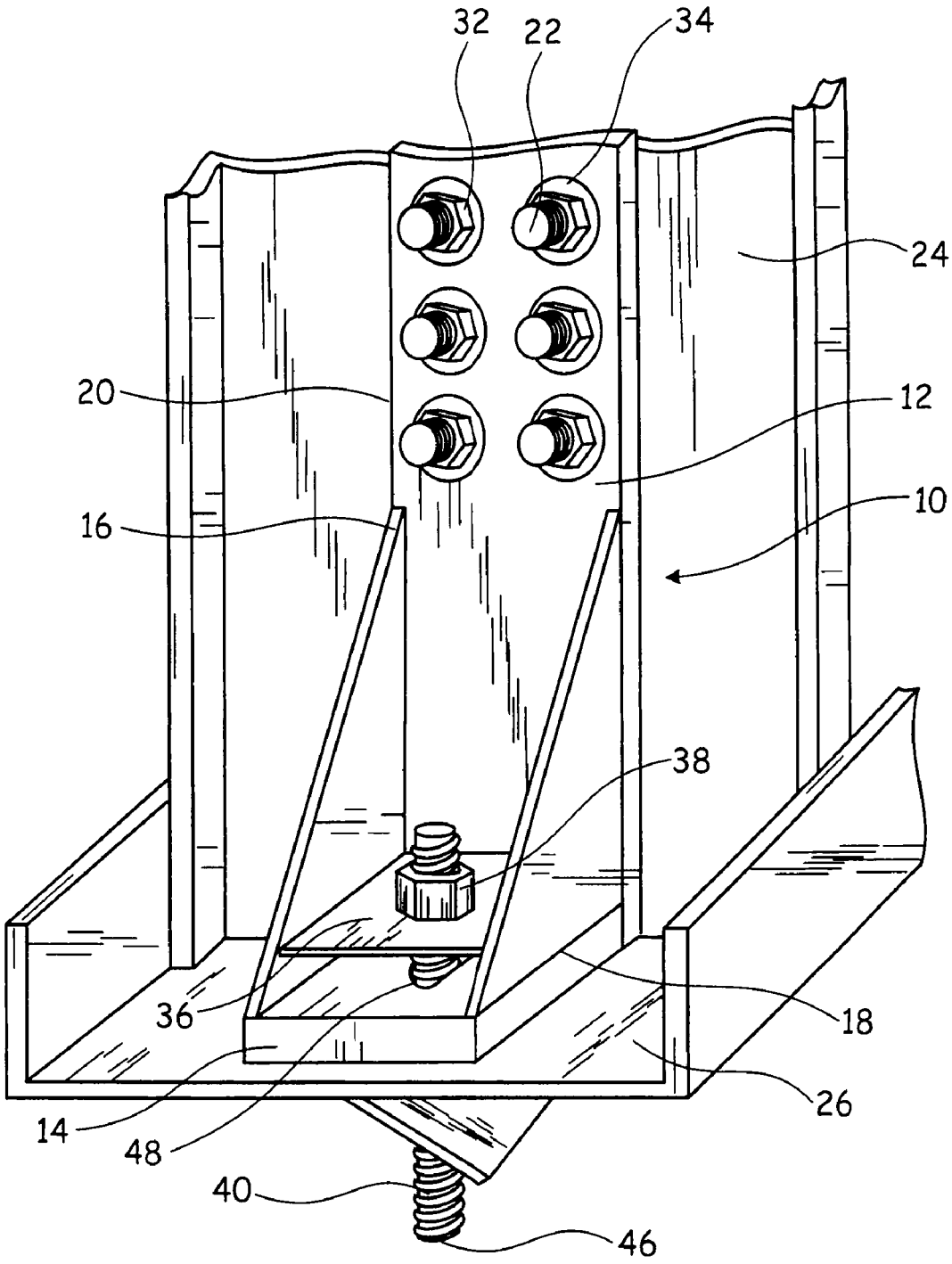
FIG. 2 is a top perspective view of a hold down clip attached to a metal stud and base according to an embodiment of the disclosure.
Figure 3:
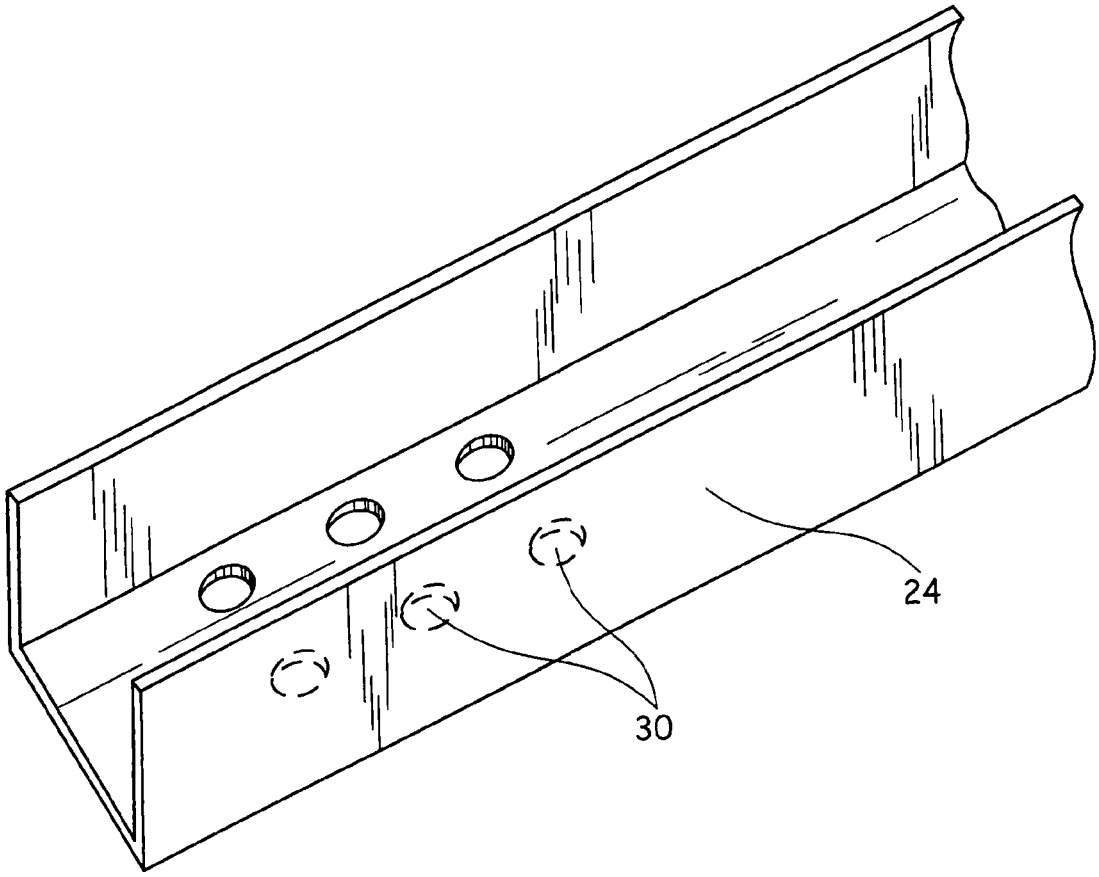
FIG. 3 is a perspective view of a metal stud for use with the hold down clip according to the disclosure.
Figure 4:
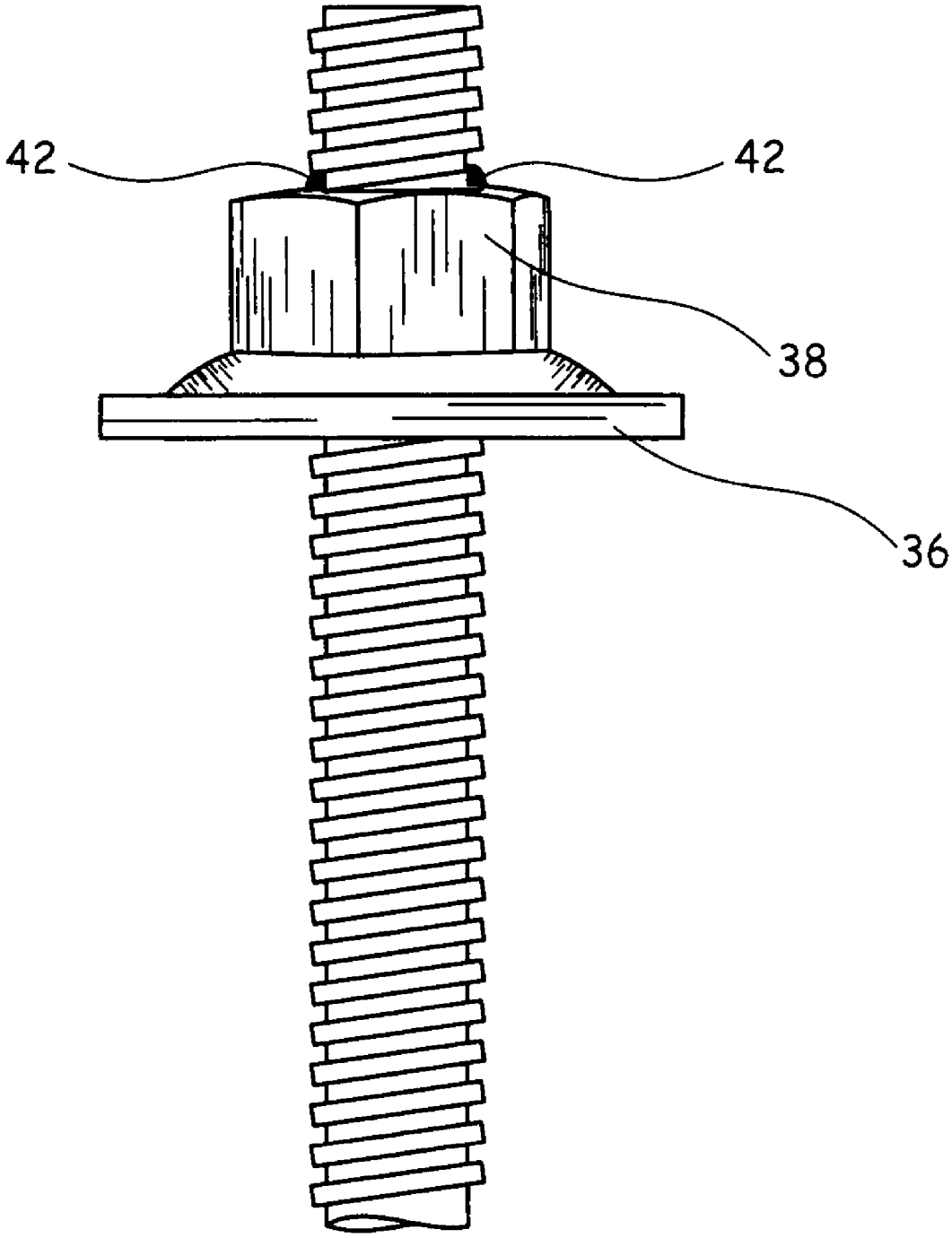
FIG. 4 is an enlarged perspective view of a bolt and fixedly attached washer and nut for a hold down clip according to the disclosure.
Figure 5:
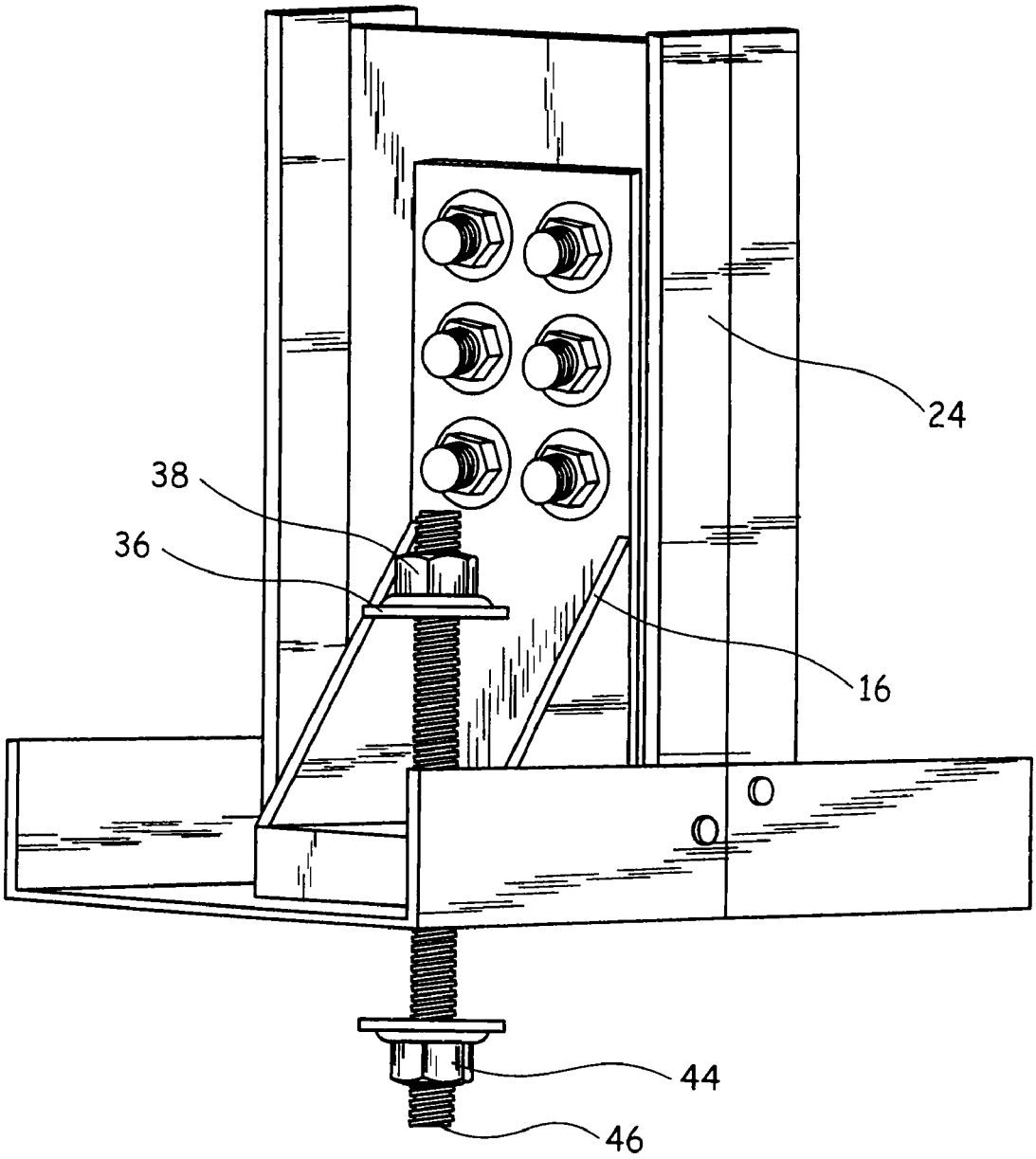
FIG. 5 is a side perspective view of a hold down clip attached to a metal stud and base according to the disclosure.
Figure 6:
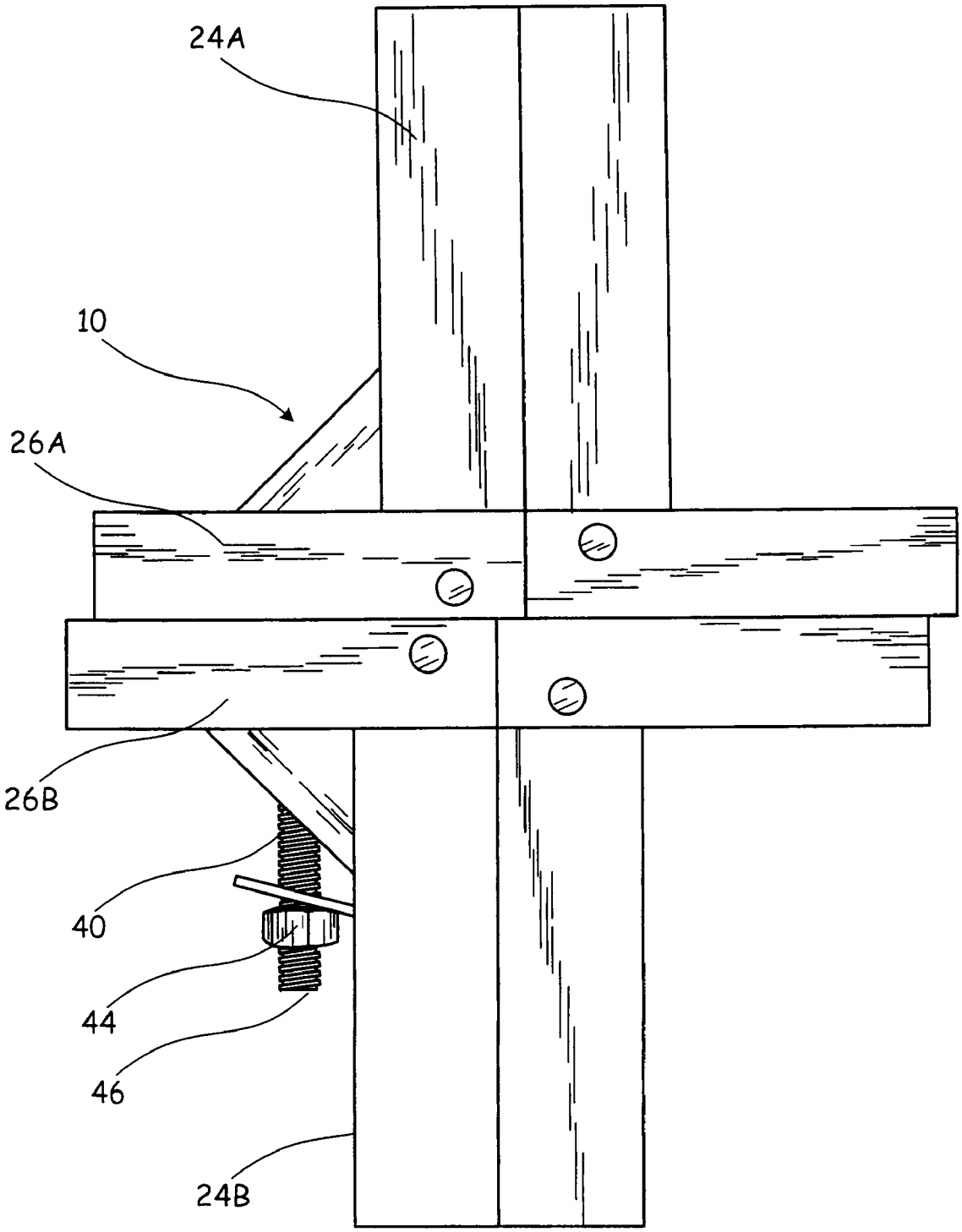
FIG. 6 is an illustration of use of a hold down clip according to the disclosure used to attach adjacent metal studs and supports to one another.

With additional reference to FIG. 2, another aspect of the disclosure relates to the use of an angular, and preferably square or rectangular, washer 36 non-removably attached to, i.e., integrated with a nut 38 (preferably secured together as by welding). The nut 38 is fixedly, i.e., non-removably attached to a hold down bolt 40, as by welds 42 as shown in more detail in FIG. 4. The washer 36 cooperates with the one or more flanges 16 to enable a nut 44 on a distal end 46 of the bolt 40 (FIG. 5) to be tightened by a single user. For example, the washer 36 may be captured between spaced apart flanges 16 to prevent rotation of the fixedly attached bolt 40 while the nut 44 is being adjusted along the bolt 40. The foregoing washer 36 and nut 38 are particularly useful in assembling adjacent metal studs 24A and 24B to one another to provide a multi-story building structure as illustrated in FIG. 6 as described in more detail below.

Figure 7:
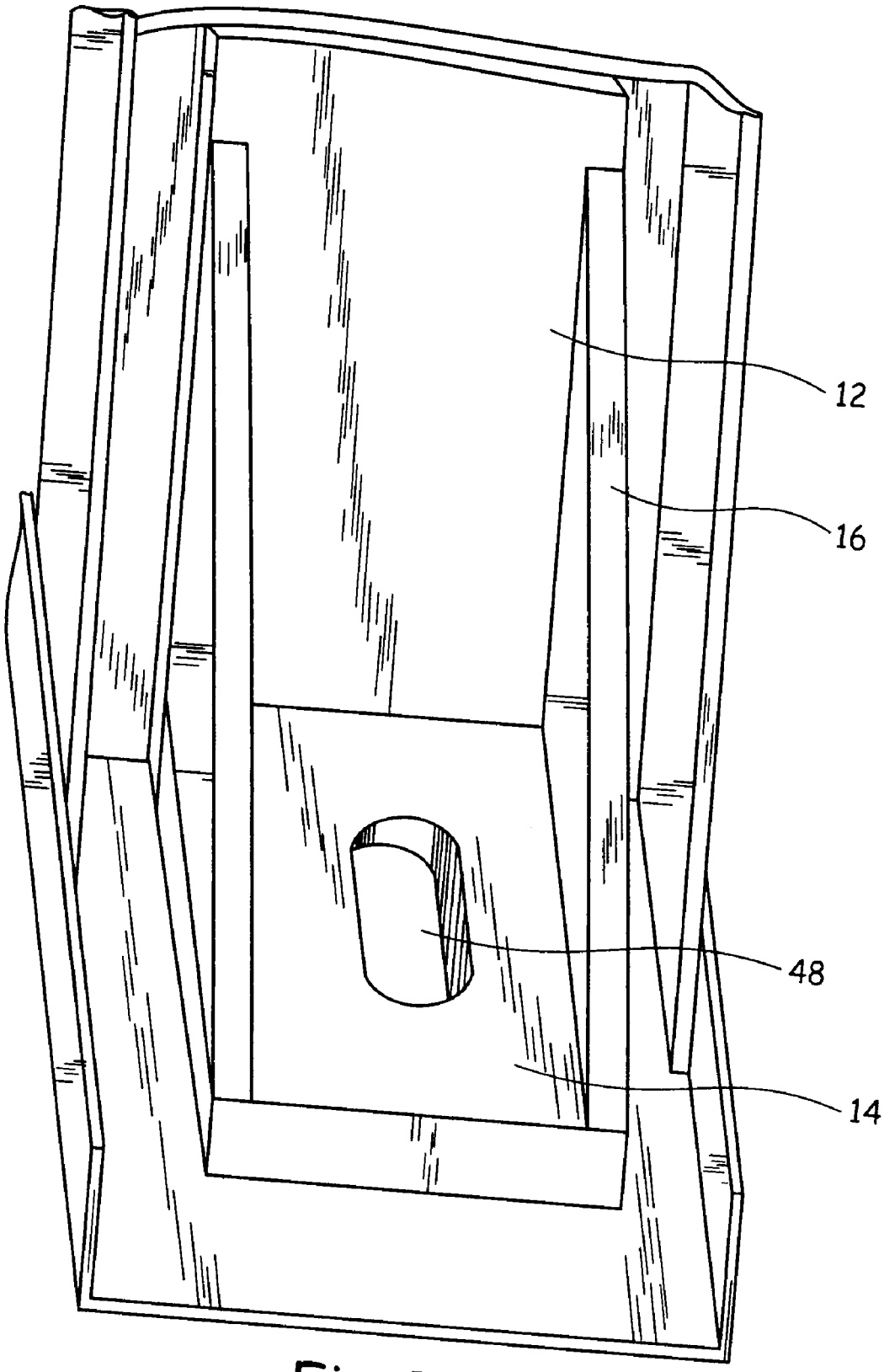
FIG. 7 is a top perspective view of a slot in a base portion of a hold down clip according to the disclosure.
Figure 8:
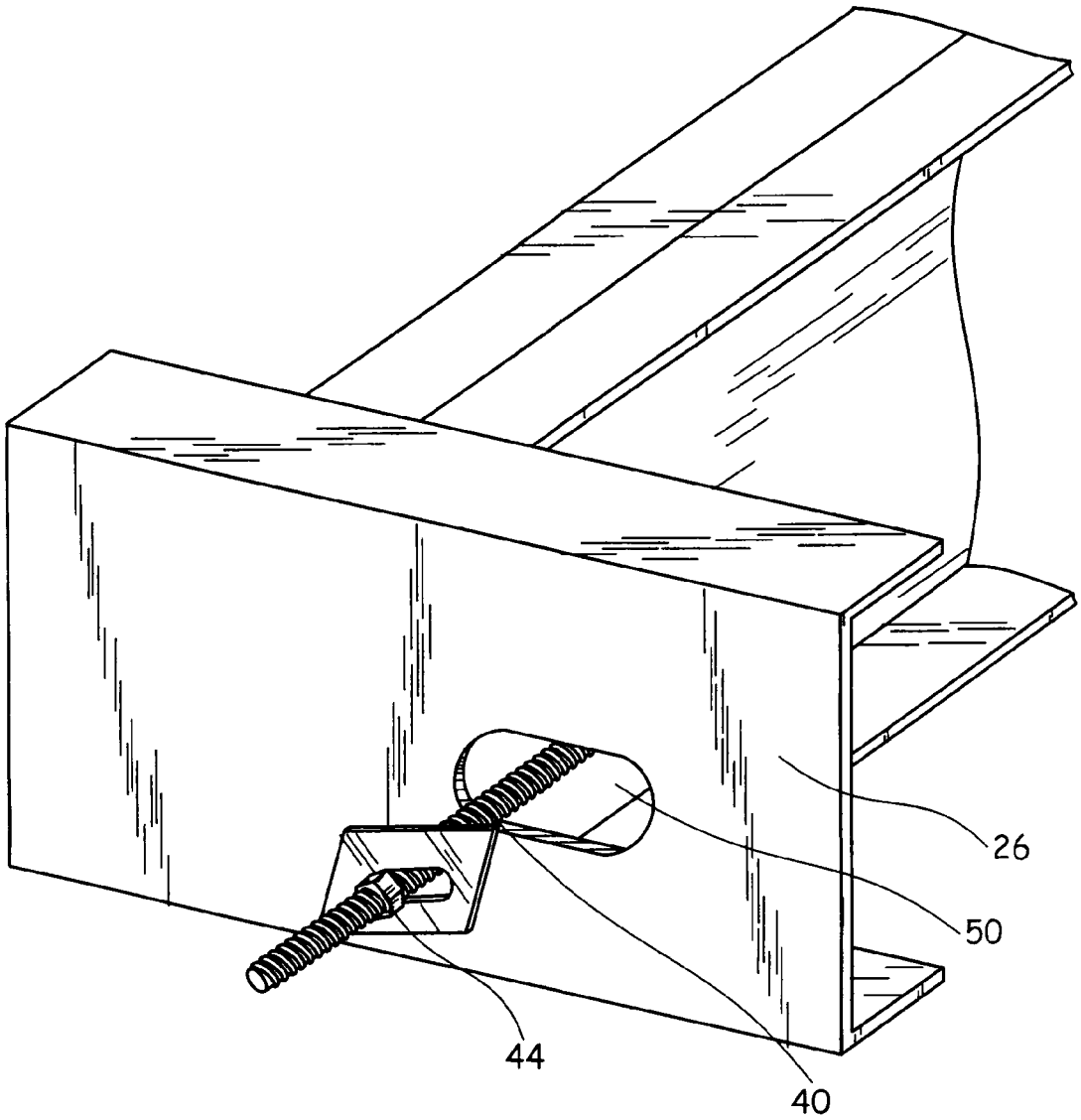
FIG. 8 is a bottom perspective view of a slot in a metal support for a stud wall.

Another advantage of the clip 10 according to the disclosure relates to the provision of an elongate slot 48 in the base portion 14 thereof as illustrated more clearly in FIG. 7. The elongate slot 48 is aligned with an elongate slot 50 in the support 26 as shown in FIG. 8. The elongate slot 48 typically has a length dimension of about 3½ inches and a width dimension of about 1½ inches. However, it is desirable that the slot 48 in the base portion 12 be configured to be just slightly smaller, e.g., about ¼ inch, in each dimension than the slot 50 in the support 26. The slots 48 and 50 enable adjacent ones of the hold down clips 10 to interconnect with one another as illustrated in FIG. 6. As shown in FIG. 6, even if the studs 24A and 24B are corresponding supports 26A and 26B are mis-aligned, the slot 48 and the corresponding slot 50 in the support 26 enable interconnection of the two assemblies.

Figure 9:
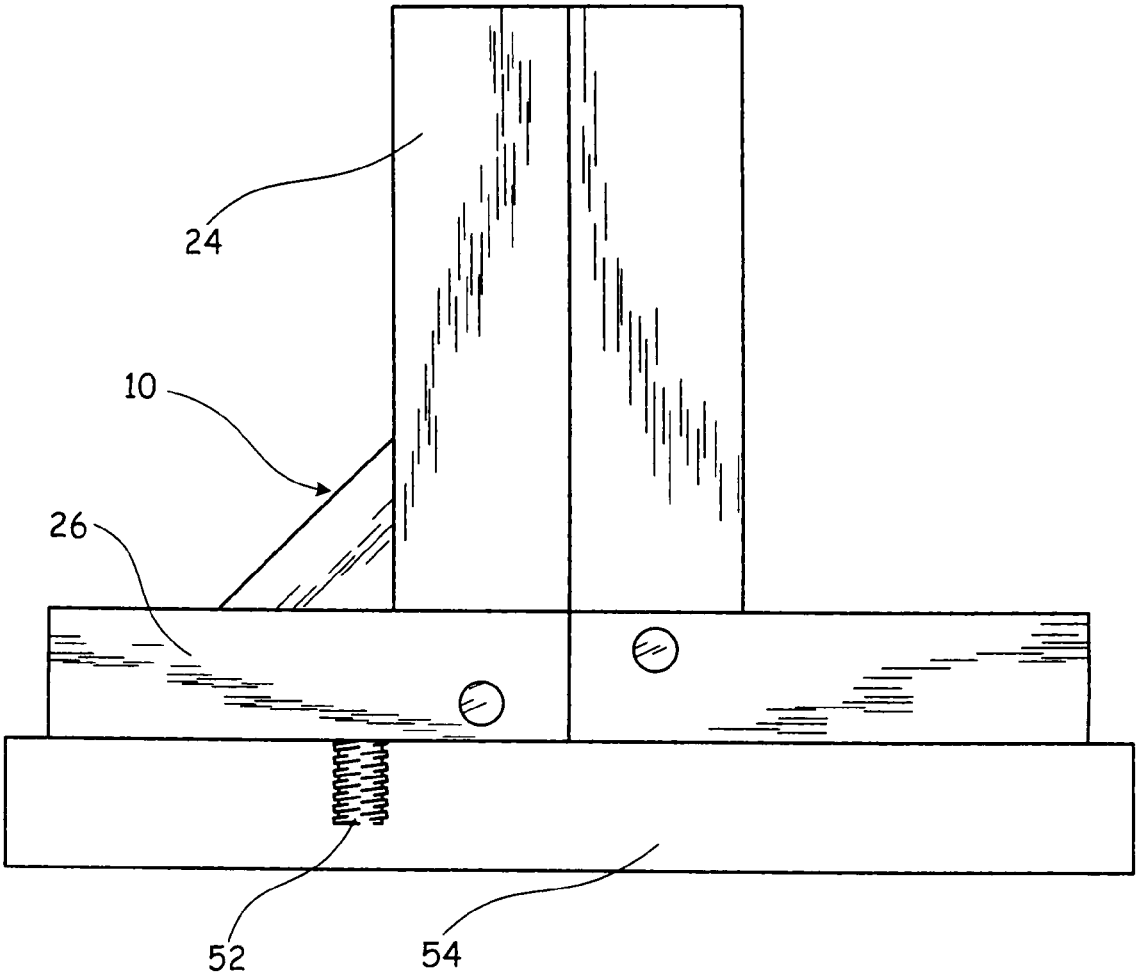
FIG. 9 is an illustration of use of a hold down clip according to the disclosure to attach a metal stud and base to a foundation.

The clip 10 may also be used with an anchor bolt 52 for attaching the clip 10 and support 26 to a floor, concrete slab, or other foundation 54 as illustrated in FIG. 9. Accordingly, the slot 48 and the slot 50 enable alignment of the studs 24 with the anchor bolt 52.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A stud wall assembly structure comprising:

a metal stud; and a hold down structure attached to the metal stud, the hold down structure comprising a base portion, a leg portion orthogonal to the base portion, a reinforcing flange attached to the leg portion and base portion, and a connecting bolt disposed in a slotted aperture in the base portion, wherein the hold down structure contains a plurality of bolt holes for attaching the leg portion to the metal stud, and wherein the connection bolt further comprises a first threaded end having a fixed non-removably attached nut and a second threaded end distal from the first threaded end having an adjustable nut and a restraining washer non-removably attached to the fixed nut.

2. The stud wall assembly structure of claim 1, wherein the restraining washer is restrained by a portion of the reinforcing flange.

3. The stud wall assembly structure of claim 1, wherein the restraining washer is restrained by a portion of the leg portion of the hold down structure.

4. The stud wall assembly structure of claim 1, wherein the metal stud is orthogonally attached to a support member, the support member having an elongate slot therein substantially aligned with the slotted aperture of the hold down structure.

5. A hold down clip for erecting metal studs for building walls, the hold down clip comprising:

a base portion containing an elongate slot therein;

a leg portion orthogonal to the base portion containing a plurality of bolt holes therein for attaching the leg portion to a metal stud;

a reinforcing flange attached to the leg portion and base portion;

a connecting bolt disposed in an elongate slot in the base portion and including a first threaded end having a fixed non-removably attached nut and a second threaded end distal from the first threaded end having an adjustable nut; and a restraining washer non-removably attached to the fixed nut.

6. The hold down clip of claim 5, wherein the restraining washer is restrained by a portion of the reinforcing flange.

7. The hold down clip of claim 5, wherein the restraining washer is restrained by a portion of the leg portion of the hold down clip.

8. A method for reinforcing metal stud for building walls, the method comprising the steps of:

providing a hold down clip, the hold down clip comprising a base portion containing an elongate slot therein, a leg portion orthogonal to the base portion containing a plurality of bolt holes, a reinforcing flange attached to the leg portion and base portion, a connecting bolt disposed in the elongate slot of the base portion and including a first threaded end having a fixed nut, a restraining washer attached to the fixed nut, and a second threaded end distal from the first threaded end having an adjustable nut; and bolting the leg portion of the hold down clip to a metal stud using a plurality of bolts.

9. The method of claim 8, wherein the connecting bolt is affixed to a floor.

10. The method of claim 8, wherein the connecting bolt is connected to an adjacent hold down clip of a metal stud.

11. The method of claim 8, wherein the restraining washer is restrained by a portion of the reinforcing flange.

12. The method of claim 8, wherein the restraining washer is restrained by a portion of the leg portion of the hold down clip.

* * * * *